US010105663B2

(12) United States Patent
Cognart et al.

(10) Patent No.: US 10,105,663 B2
(45) Date of Patent: Oct. 23, 2018

(54) STIRRING PROPELLER WITH BLADES MADE OF SHEET BENT ALONG TWO LONGITUDINAL BENDS

(71) Applicant: MILTON ROY EUROPE, Pont-Saint-Pierre (FR)

(72) Inventors: Patrice Cognart, Bois le Roi (FR); Frederic Savreux, Saint Mammes (FR)

(73) Assignee: MILTON ROY EUROPE, Pont-Saint-Pierre (FR)

( * ) Notice: Subject to any disclaimer, the term of this patent is extended or adjusted under 35 U.S.C. 154(b) by 0 days.

(21) Appl. No.: 15/301,559

(22) PCT Filed: Mar. 31, 2015

(86) PCT No.: PCT/EP2015/056951

§ 371 (c)(1),
(2) Date: Oct. 3, 2016

(87) PCT Pub. No.: WO2015/150353

PCT Pub. Date: Oct. 8, 2015

(65) Prior Publication Data

US 2017/0113196 A1 Apr. 27, 2017

(30) Foreign Application Priority Data

Apr. 4, 2014 (EP) ..... 14305498

(51) Int. Cl.
*B01F 7/22* (2006.01)
*B01F 7/00* (2006.01)

(52) U.S. Cl.
CPC ..... *B01F 7/00375* (2013.01); *B01F 7/00341* (2013.01); *B01F 7/22* (2013.01); *B01F 2215/0422* (2013.01)

(58) Field of Classification Search
CPC .... B01F 7/06; B01F 7/00275; B01F 7/00383; B01F 7/00375; B01F 7/00366; B01F 7/00341; B01F 7/22; B01F 2215/0422
(Continued)

(56) References Cited

U.S. PATENT DOCUMENTS 1,815,529 A * 7/1931 Shurtleff ..... F04D 29/384 415/119
1,838,453 A * 12/1931 Rosen ..... B64C 11/18 416/237

(Continued)

FOREIGN PATENT DOCUMENTS

CA 2955755 A1 * 1/2016 ..... B01F 7/00016
DE 2624991 C2 * 4/1985 ..... B01F 7/00341

(Continued)

OTHER PUBLICATIONS

International Search Report, dated Jun. 25, 2015, from corresponding PCT Application.

*Primary Examiner* — Charles Cooley
(74) *Attorney, Agent, or Firm* — Young & Thompson

(57) ABSTRACT

Stirrer (M) that includes at least two blades and is able to be fixed to a rotary shaft, wherein each blade has a leading edge facing the fluid to be stirred and a trailing edge facing away from the leading edge, and wherein each blade is obtained by bending a flat metal sheet, each blade having two longitudinal bends, the length of each bend being greater than 60% of the maximum radius of the blade.

17 Claims, 4 Drawing Sheets

(58) Field of Classification Search
USPC ..... 366/270, 330.1–330.7; 416/237
See application file for complete search history.

(56) References Cited

U.S. PATENT DOCUMENTS 2,028,413 A * 1/1936 Sackett ..... C05B 19/00 159/4.04
2,074,387 A * 3/1937 Gill ..... F04D 29/28 416/211
2,103,243 A * 12/1937 Bradford, Jr. ..... B64C 11/00 416/202
2,148,555 A * 2/1939 Hicks ..... B64C 11/16 416/202
3,030,083 A * 4/1962 Stiffler ..... B01F 7/00475 366/316
3,147,958 A * 9/1964 Stiffler ..... A47J 43/0722 241/98
4,135,858 A * 1/1979 Entat ..... B01F 7/00341 416/223 R
4,147,437 A * 4/1979 Jonqueres ..... B01F 7/00341 366/330.5
4,177,012 A * 12/1979 Charles ..... F01P 7/06 416/132 A
4,468,130 A * 8/1984 Weetman ..... B01F 7/00341 366/330.2
4,479,721 A * 10/1984 Rieger ..... B01F 7/00158 366/147
4,519,715 A * 5/1985 Golobic ..... B01F 7/00341 366/343
4,544,281 A * 10/1985 Wilkinson ..... B01F 15/00 366/330.1
4,618,313 A * 10/1986 Mosiewicz ..... B64C 11/18 416/23
4,722,608 A * 2/1988 Salzman ..... B01F 7/00016 366/270
5,052,892 A * 10/1991 Fasano ..... B01F 7/001 416/204 R
5,253,980 A * 10/1993 Nishioka ..... B01F 7/00316 416/227 R
5,297,938 A * 3/1994 Von Essen ..... B01F 7/00341 366/330.2
5,326,226 A * 7/1994 Wyczalkowski ... B01F 7/00341 29/889.3
5,399,014 A * 3/1995 Takata ..... B01F 7/00291 366/262
5,595,475 A * 1/1997 Weiss ..... B01F 7/00341 416/223 R
5,813,837 A * 9/1998 Yamamoto ..... B01F 7/00341 366/270
5,988,604 A * 11/1999 McWhirter ..... B01F 3/0478 261/119.1
6,250,797 B1 * 6/2001 Weetman ..... B01F 3/04531 261/93
6,796,707 B2 * 9/2004 Gigas ..... B01F 7/00158 366/327.1
6,860,631 B2 * 3/2005 McWhirter ..... B01F 3/04609 261/91
6,877,959 B2 * 4/2005 McWhirter ..... B01F 3/0478 366/265
7,114,844 B2 * 10/2006 Weetman ..... B01F 3/0478 366/328.3
7,172,337 B2 * 2/2007 Roszczenko ..... B01F 3/04248 366/270
7,278,598 B2 * 10/2007 Katz ..... A47J 43/0711 241/282.1
7,296,925 B2 * 11/2007 Himmelsbach ..... B01F 7/00275 366/330.3
7,351,041 B2 * 4/2008 Uselton ..... F04D 29/384 415/119
7,374,333 B2 * 5/2008 Eisenkraetzer ..... B01F 7/00166 366/330.3
7,401,974 B2 * 7/2008 Himmelsbach ..... B01F 7/00341 366/330.3
7,473,025 B1 * 1/2009 Howk ..... B01F 7/00341 29/889.7
7,552,885 B2 * 6/2009 Katz ..... A47J 43/0711 241/282.1
7,874,071 B2 * 1/2011 Tobler ..... F25C 5/007 241/282.1
8,220,986 B2 * 7/2012 Janz ..... B01F 7/00341 366/330.1
D681,690 S * 5/2013 Xia ..... D15/29
9,138,698 B2 * 9/2015 Lilja ..... B01F 7/00341
9,186,022 B1 * 11/2015 Jacobsen ..... B01F 7/00275
9,248,420 B2 * 2/2016 Rawlings ..... B01F 7/22
9,272,251 B2 * 3/2016 Jones ..... B01F 7/00275
9,289,733 B2 * 3/2016 Maxon ..... B01F 7/22
9,334,874 B2 * 5/2016 Xia ..... B01F 7/00375
D766,658 S * 9/2016 Strommer ..... D7/376
D767,332 S * 9/2016 Strommer ..... D7/376
9,604,183 B2 * 3/2017 Dinnison ..... B01F 7/00058
9,713,799 B2 * 7/2017 Mattson ..... B01F 7/00058
9,731,256 B2 * 8/2017 Dinnison ..... B01F 7/00366
9,849,430 B2 * 12/2017 Shramo ..... B01F 7/00641
9,879,697 B2 * 1/2018 Strommer ..... F04D 29/648
2004/0228210 A1 * 11/2004 Himmelsbach ..... B01F 7/00275 366/330.3
2005/0007874 A1 * 1/2005 Roszczenko ..... B01F 3/04248 366/270
2005/0243646 A1 * 11/2005 Eisenkraetzer ..... B01F 7/00166 366/330.3
2006/0187750 A1 * 8/2006 Aldrich ..... B01F 7/0015 366/270
2007/0268779 A1 * 11/2007 Himmelsbach ..... B01F 7/00341 366/330.3
2008/0130406 A1 * 6/2008 Rosso ..... B01F 7/001 366/342
2009/0238033 A1 * 9/2009 Wyczalkowski ..... B01F 3/1221 366/305
2010/0124147 A1 * 5/2010 Janz ..... B01F 7/001 366/343
2012/0039721 A1 * 2/2012 Lilja ..... B01F 7/00341 416/241 R
2012/0045834 A1 * 2/2012 Jones ..... B01F 7/00275 435/383
2014/0211585 A1 * 7/2014 Maxon ..... B01F 7/22 366/279
2015/0044057 A1 * 2/2015 Dinnison ..... B01F 7/00366 416/237
2015/0165397 A1 * 6/2015 Higbee ..... B01F 7/00275 366/343
2015/0165399 A1 * 6/2015 Rawlings ..... B01F 7/22 366/265
2015/0240832 A1 * 8/2015 Xia ..... B01F 7/00375 416/243
2016/0339402 A1 * 11/2016 Janz ..... B01F 7/00341
2017/0113196 A1 * 4/2017 Cognart ..... B01F 7/00375
2017/0306983 A1 * 10/2017 Strommer ..... F04D 29/648

FOREIGN PATENT DOCUMENTS

DE 9418136 U1 * 12/1994 ..... B01F 7/00341
DE 4401596 A1 * 7/1995 ..... B01F 7/00341
DE 19720120 A1 * 11/1998 ..... B01F 7/00341
DE 19720120 C2 * 3/2001 ..... B01F 7/00341
DE 102010011113 A1 * 9/2011 ..... B01F 7/001
EP 0577456 A1 * 1/1994 ..... B01F 7/00341
EP 0 771 586 A1 5/1997
EP 0577456 B1 * 1/1999 ..... B01F 7/00341
EP 1475145 A2 * 11/2004 ..... B01F 7/00275
EP 1588758 A1 * 10/2005 ..... B01F 7/00166
EP 2883602 A1 * 6/2015 ..... B01F 7/22
EP 2926892 A1 * 10/2015 ..... B01F 7/00375
FR 1 578 991 A1 8/1969
FR 1 600 744 A 7/1970
FR 1600744 A * 7/1970 ..... B01F 7/00341
FR 2692809 A1 * 12/1993 ..... B01F 7/00341
GB 1528399 A * 10/1978 ..... B01F 7/00341
KR 20150070003 A * 6/2015 ..... B01F 7/22
WO WO-0035570 A3 * 10/2000 ..... B01F 7/00341

(56) References Cited

FOREIGN PATENT DOCUMENTS

| | | | | | |
|---|---|---|---|---|---|
| WO | WO-2008025975 | A1 * | 3/2008 | ..... | B01F 7/00341 |
| WO | 2010/103172 | A1 | 9/2010 | | |
| WO | WO-2010103172 | A1 * | 9/2010 | ..... | B01F 7/00341 |
| WO | WO-2010125006 | A1 * | 11/2010 | ..... | B01F 7/00275 |
| WO | WO-2009099862 | A3 * | 4/2011 | ..... | B01F 7/00341 |
| WO | WO-2011122370 | A1 * | 10/2011 | ..... | B01F 3/18 |
| WO | 2013/124539 | A1 | 8/2013 | | |
| WO | WO-2013124539 | A1 * | 8/2013 | ..... | B01F 7/00375 |
| WO | WO-2015095260 | A1 * | 6/2015 | ..... | B01F 7/00058 |
| WO | WO-2016071567 | A1 * | 5/2016 | ..... | F04D 29/181 |
| WO | WO-2016071568 | A1 * | 5/2016 | ..... | F04D 29/181 |
| WO | WO-2017037156 | A1 * | 3/2017 | ..... | B01F 7/00375 |

* cited by examiner

STIRRING PROPELLER WITH BLADES MADE OF SHEET BENT ALONG TWO LONGITUDINAL BENDS

BACKGROUND OF THE INVENTION

Field of the Invention

The present invention relates to a stirring member that comprises at least two blades and is able to be fastened to a rotation shaft.

The manufacture of numerous products requires a homogenizing, diluting, dissolving, reheating, etc. operation.

To this end, use is frequently made of mechanical stirrers having a rotary shaft, which are driven frequently by way of an electric motor, and are provided with a shaft and a stirring member or stirrer. The assembly is thus made up of a container, a product and a stirrer.

The present invention concerns the design of stirrers which are generally propellers or turbines that comprise a member known as a stirring member mounted on a rotation shaft.

A turbine is provided with straight blades at 90° to the vertical, but any member made up of straight blades, even ones positioned in an inclined manner, is customarily known as a turbine.

A turbine generates a radial flow that generates shear, dissipating energy.

A propeller is preferably formed by a steeply inclined portion of helical pitch of a curved or bent sheet.

A propeller produces an axial and methodical flow.

The rotation of the stirring member causes the liquid to be displaced, making it possible to carry out the desired operation, more or less effectively depending on the shape of the member, its size and the speed of rotation.

The rotation can also cause shear and dissipate energy in the liquid to be mixed.

Sometimes, these two phenomena are necessary, during a reaction, for the formation of an emulsion.

The invention deals more specifically with the case in which the aim is to minimize the losses of energy by shear in order to obtain a displacement of the liquid and the mixing thereof with small losses, this entailing increased efficiency.

In such a case, it is the use of a propeller that gives the best result. This is because these operations only require that the product is set in motion, i.e. a pumping flow.

The aim is to produce this flow with the least possible energy, and it is known that propellers consume less energy than turbines for an equivalent flow.

Description of the Related Art

In previous centuries, use was made only of turbines, which did not require a particular design; then, around a century ago, marine propellers, which are more efficient and less energy-consuming, were developed.

Two large families of propellers, which are represented by the patents U.S. Pat. No. 4,147,437 and FR 1 578 991, can be distinguished.

These two families of propellers are still used today, given their performance in relation to marine propellers.

However, in some markets, it proves difficult to use turbines, on account of the high power required and consequently the cost, or high-efficiency propellers.

This is because such a use is frequently considered to be too expensive, since the benefits of the high efficiency are not fully appreciated, only the investment cost actually being taken into consideration. The high efficiency is considered to be advantageous only for large machines, or when the cost of the energy is high or at least taken into account.

It is a difficult and/or lengthy, and thus costly, process to manufacture high-efficiency propellers, and it can only be carried out by special machines. This is because there are numerous technical problems on account notably of the thickness of the sheet and the curves that are tricky to obtain. It is not possible to have these propellers manufactured at another workshop or on another continent, for example, which results in high transportation costs.

Bent propellers already exist on the market, but these have a very specific shape with a bend at the blade corner so as to limit radial leakage. The improvement in efficiency was not the technical problem that the designers thereof intended to deal with.

There is therefore a need for a propeller that is easy to construct, i.e. without special material or particular skill, provides a good flow, which is the essential determining factor of stirring, but without consuming too much power as would be the case for a simple blade having a flat and inclined shape, which would actually result in high power, a large shaft and a great thickness of the blade and ultimately in an uncompetitive manufacturing cost.

BRIEF SUMMARY OF THE INVENTION

According to the invention, a stirring member that comprises at least two blades and is able to be fastened to a rotation shaft is characterized in that each blade has a leading edge facing the fluid to be stirred and a trailing edge facing away from the leading edge, characterized in that each blade is obtained by bending a flat sheet, each blade having two longitudinal bends, the length of each bend being greater than 60% of the maximum radius of the blade.

The length of each bend may be greater than 75% of the maximum radius of the blade.

Advantageously, the two bends are parallel.

At least one of the bends may be perpendicular to the outer edge of the propeller.

The angle between the leading edge and the radial axis of the blade passing through the center of rotation and perpendicular to the outer edge, referred to as the angle of incidence, is positive, the distal end of the outer edge, remote from the shaft, meeting the fluid before the proximal end when the member is in rotation.

The angle of incidence may be between 4 and 20°, preferably between 6 and 15°.

Advantageously, the stirring member comprises only two blades so as to make it easier to introduce it through the opening in the container of fluid to be stirred.

Each blade may have, on account of the presence of the two bends, a substantially U-shaped cross section in a plane parallel to the axis of rotation of the member and parallel to the outer edge of the blade.

The section of each blade may also be substantially Z-shaped in a plane parallel to the axis of rotation of the member and parallel to the outer edge of the blade.

The trailing edge may be at an angle of between 30 and 70° to the intersection with the section plane of a plane orthogonal to the axis of rotation of the member, this angle being referred to as the departure angle.

Preferably, if the width of the blade at its distal end is denoted 1 and the width of the blade at its base at the level of the axis is denoted L, then $l>0.5$ L.

Preferably, for each blade, the angle of attack a between the face containing the leading edge and the central face is between 13 and 25°.

BRIEF DESCRIPTION OF THE DRAWINGS

Further features and advantages of the invention will become apparent from the following description of a preferred embodiment with reference to the appended drawings but without any limiting nature. In these drawings.

DETAILED DESCRIPTION OF THE PREFERRED EMBODIMENTS

Throughout the following description of different embodiments of propellers according to the invention, relative terms such as "upper", "lower", "front", "rear", "horizontal" and "vertical" should be interpreted as when the propeller according to the invention is installed in an operating situation.

Figure 1:
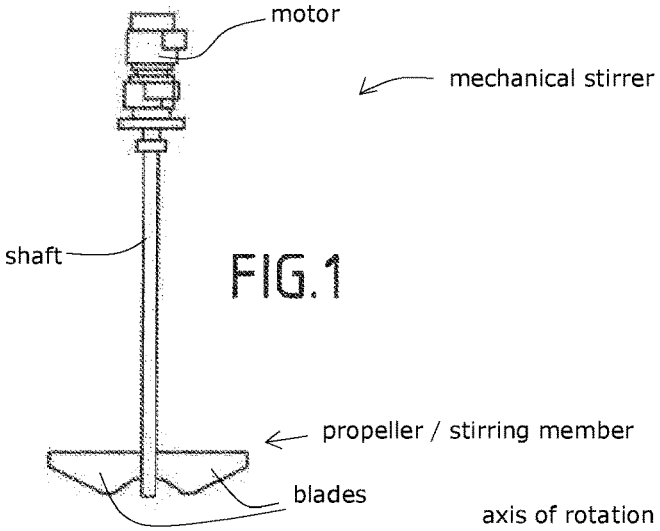
FIG. 1 is a side elevation view of a stirrer according to the invention.
Figure 2:
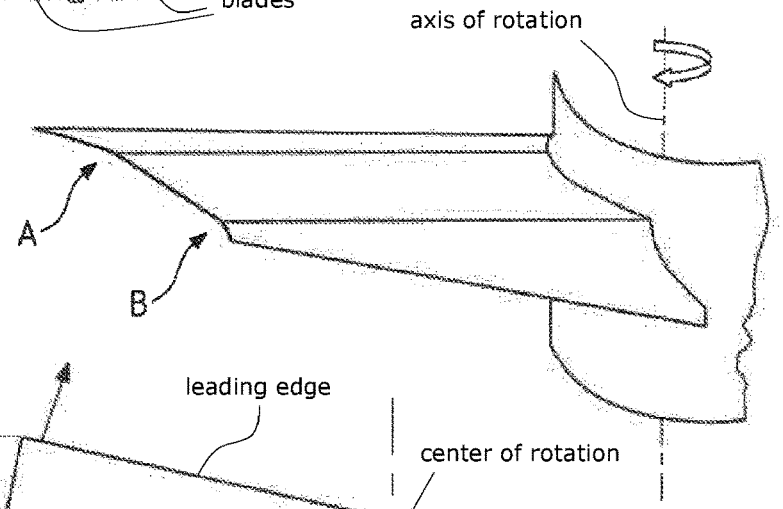
FIG. 2 is a schematic perspective view, on a larger scale, of a first embodiment of a blade of a stirring member according to the invention.
Figure 3:
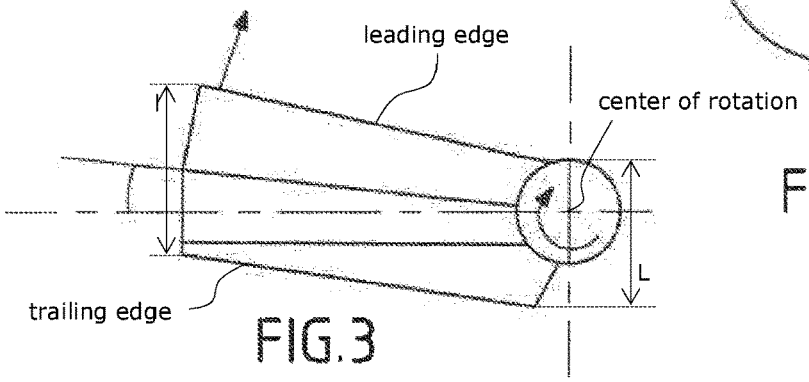
FIG. 3 is a top view of the blade in FIG. 2.
Figure 4:
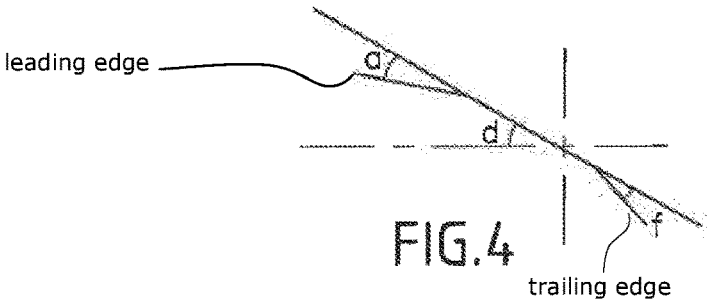
FIG. 4 is an end-on view of the blade in FIG. 2, FIG. 5 and FIG. 6 are perspective views illustrating the introduction of stirring propellers having three and two blades into a container.

FIGS. 2 to 4 show a first embodiment of a propeller according to the invention, which is produced with two bends, this solution being inexpensive and able to be produced with the aid of tools which are available in most mechanical metal workshops.

Inasmuch as each blade of the propeller has two bends, each blade thus has three faces and, in a cross-sectional view, it is necessary to define three angles in order to define the profile of the blade. These angles are more particularly visible in FIG. 4.

The angle of attack is the angle a between the face having the leading edge and the central face. The angle d is the positioning angle between the central face of the blade and the horizontal when the axis of rotation is vertical. The departure angle f is the angle between the face having the trailing edge and the central face.

This propeller has an angle of attack a and a departure angle f of 21°. The first bend A, that is to say the one which will meet the fluid first, is made along an axis passing through the axis of rotation of the propeller. The second bend is denoted B. It may be noted that the distal end of the trailing edge is situated forward of the proximal end of this same trailing edge and with respect to the direction of rotation of the propeller. The distal end will thus meet the fluid first.

The blades are bent so as to obtain a camber coefficient of less than 12%, so as to improve the energy efficiency. The angle of attack is between 13 and 22° so as to have a suitable Cx. Specifically, beyond 30°, the radial forces generated will be very high. This then approaches the situation of turbines.

The area of the blade is generous and virtually in the form of a quadrilateral, so as to obtain a high pumping flow since the volume displaced depends on the surface area of the blade.

If the width of the blade at its end is denoted l and the width of the blade at its base at the level of the axis is denoted L, the values of l and L are very close and l>0.5 L and preferably l>0.75 L.

This element has been preferred even if it runs counter to common practice. This is because the majority of propellers have a narrow end, in the form of a trapezoid, so as to limit the torque by narrowing the blade at its end.

Studies have shown that, given the combination of angles chosen, the bends in the blade and the shape of the latter, the performance compared with known propellers is quite acceptable.

If:

P=hydraulic pressure

ΔP=pressure difference between the inlet and the outlet of the member

Q=flow

D=diameter of the member

N=speed of rotation of the member

ρ=density v=speed of the fluid

S=area of the member k=constant the flow of a propeller is given by the following simple equation:

$$Qp=Nq\ ND^3$$

where Nq is the dimensionless number that characterizes the propeller (its shape, the number of blades, etc.).

The power consumed is calculated as follows:

$$P=Np\ \rho\ N^3\ D^5$$

where Np is the dimensionless number that characterizes the propeller (its shape, the number of blades, etc.).

The efficiency is the ratio of the energy that produces the pumping flow and the energy necessary for turning the member.

The efficiency can be expressed simply by the general equation of fluid mechanics and the simplified Bernoulli equation:

General equation of fluid mechanics:

$$P1=\rho\Delta PQ \quad (1)$$

Pumping flow:

$$Qp=Nq\ ND^3 \quad (2)$$

Power needed to rotate the member:

$$P2=Np\ \rho\ N^3\ D^5 \quad (3)$$

Simplified Bernoulli equation:

$$\Delta P = 1/2\rho v^2$$

$$v = Q/S =$$

$$v = \frac{NqND^3}{\pi\frac{D^2}{4}} = kND$$

$$\frac{P2}{P3} = k\frac{Nq^3}{Np}$$

Note that the calculation is identical when the power consumed in order to generate 1 $m^3/h$ is sought, for example.

The following is noted for example:

| Member type | Nq | Np | Efficiency |
|---|---|---|---|
| Novel 3-blade propeller | 0.68 | 0.58 | 0.54 |
| Novel 2-blade propeller | 0.59 | 0.40 | 0.50 |
| Prior art 1 | 0.60 | 0.41 | 0.53 |
| Prior art 2 | 0.61 | 0.49 | 0.46 |
| Turbine having blades inclined at 45° | 0.75 | 1.20 | 0.37 |
| Turbine having 6 straight blades | 0.85 | 5.5 | 0.12 |

It can be seen that the efficiencies of the proposed propellers are particularly good compared with the prior art and conventional propellers and turbines such as the marine propeller or the turbine having blades inclined at 45°.

The number of blades on the propellers increases the amount of liquid displaced but also the power consumed.

Without being quite proportional, it is often noted that the power consumed increases proportionally with the number of blades by a factor of 0.8.

However, in the present case, given the surface area and the angles, the average speeds of fluid show that with two blades the power decreases by 31% compared with a propeller having three blades, while the flow decreases only by 13%.

There are thus multiple advantages in using a propeller with two blades.

From an economical point of view, manufacturing two blades instead of three allows a 33% saving of material, of labor for forming the blade and welding it on a hub.

It is easier to install the propeller. This is because, depending on the diameter of the shaft, it is sometimes not possible to install three blades around the latter.

In addition, some products are partially destroyed by the shear brought about by the blades. This is because, on each rotation, the blade "cuts" the product in order to break it (flocs, emulsion, polymers, etc.) and a member equipped with two blades will only shear twice per rotation and not three times.

Figure 5:
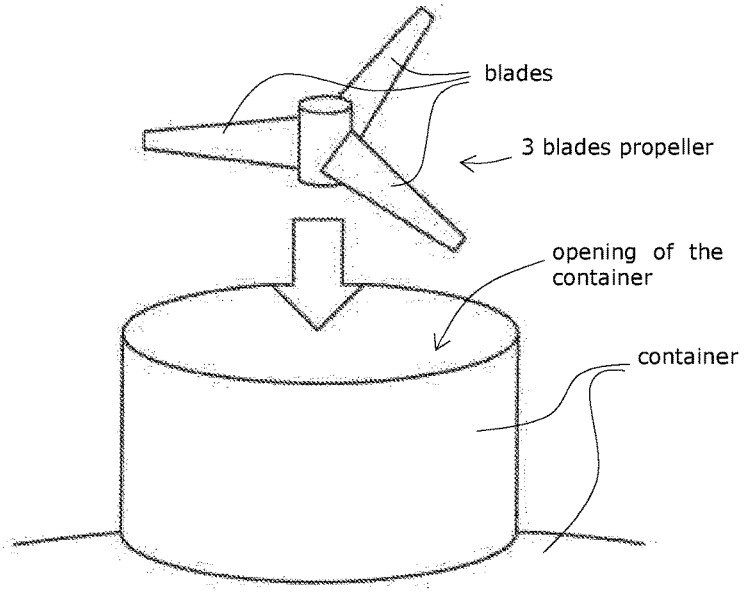
Figure 6:
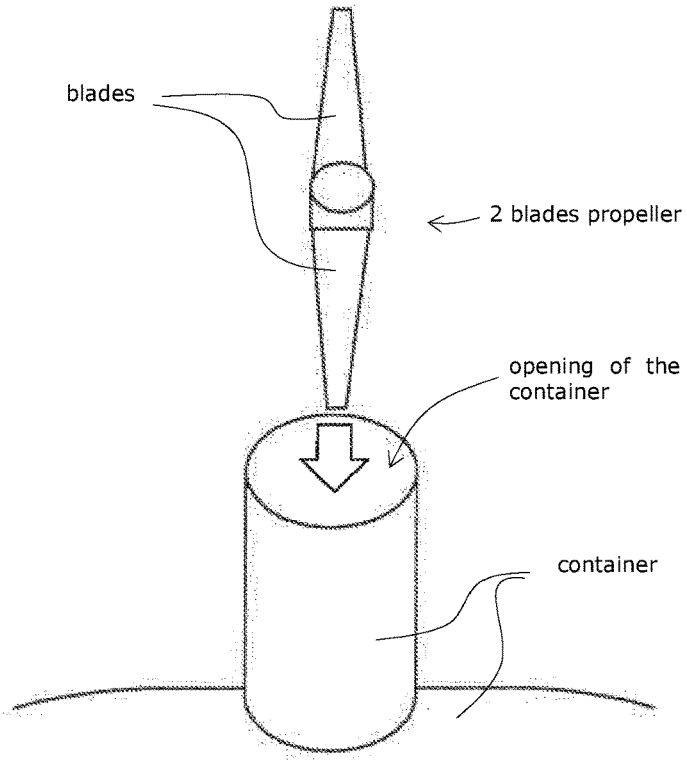
Figure 7:
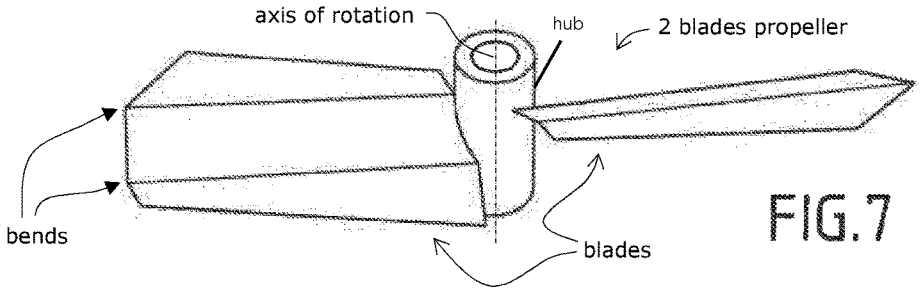
FIG. 7 is a schematic perspective view of a second embodiment of a stirring propeller according to the invention.
Figure 8:
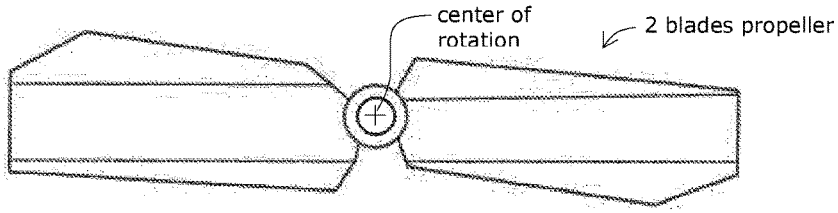
FIG. 8 is a top view of the propeller in FIG. 7.
Figure 9:
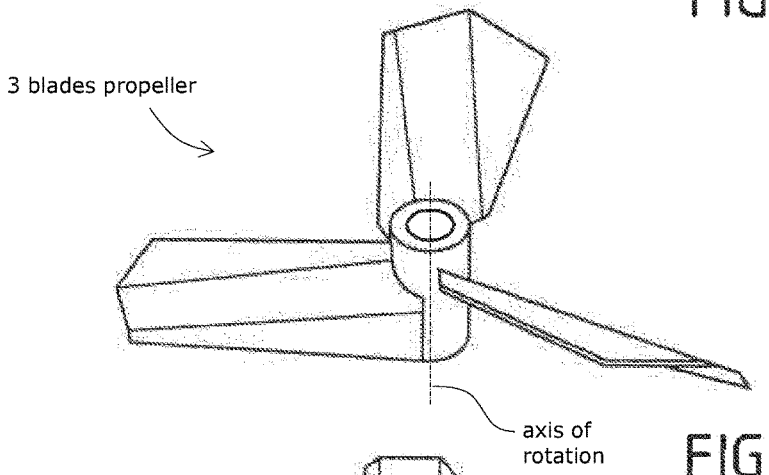
FIG. 9 is a view similar to FIG. 7 of a third embodiment of a propeller according to the invention, having three blades.
Figure 10:
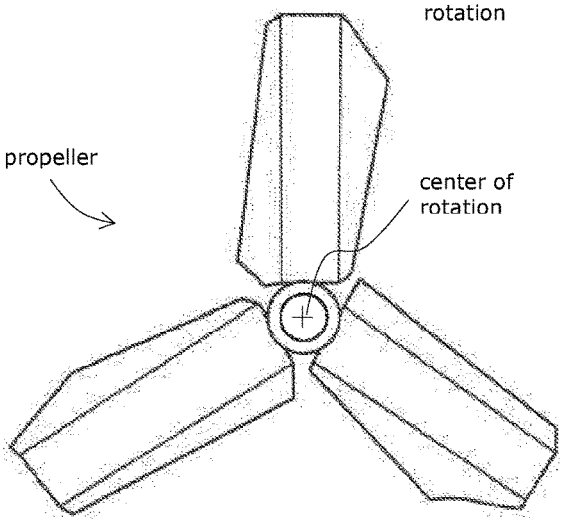
FIG. 10 is a top view of the propeller in FIG. 9.
Figure 11:
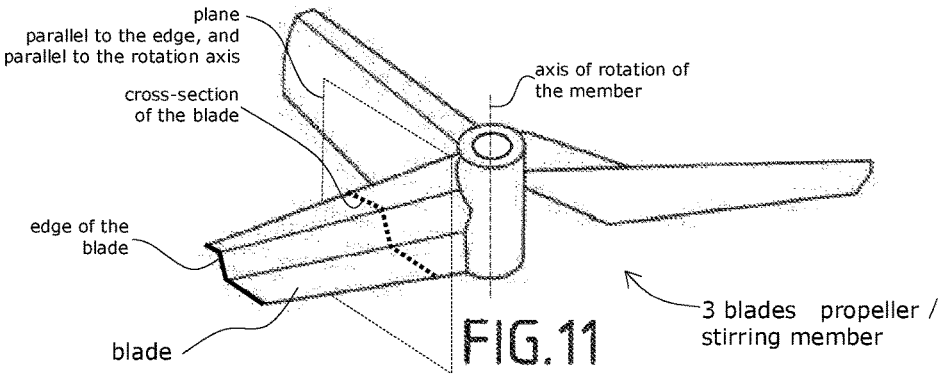
FIG. 11 is a view similar to FIG. 7 of a fourth embodiment of a propeller according to the invention, having three blades.
Figure 12:
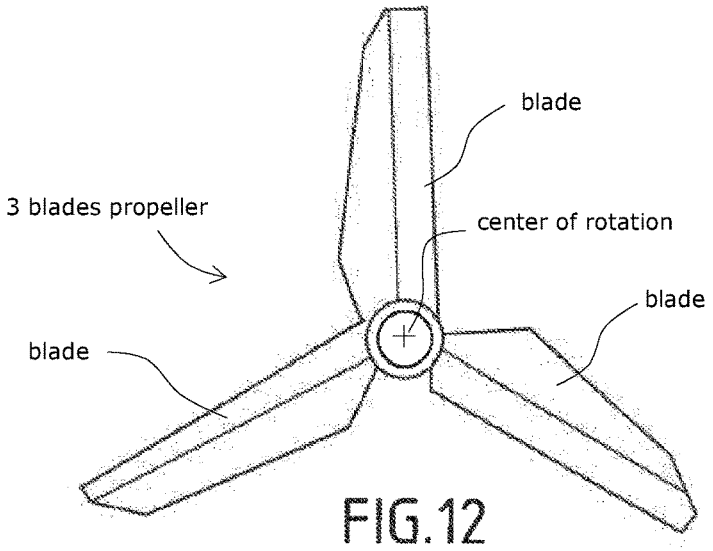
FIG. 12 is a top view of the propeller in another embodiment of a propeller according to the invention.

Finally, the propeller can be made in one piece for different reasons, for example welded to the driveshaft to allow its possible coating for use in a corrosive or abrasive medium or when it is not possible to subsequently fasten it. The three-blade propeller is particularly difficult to introduce into a tube when the member exceeds 500 mm, but a two-blade propeller having the same diameter is easy to introduce, as illustrated in FIGS. 5 and 6.

Figure 13:
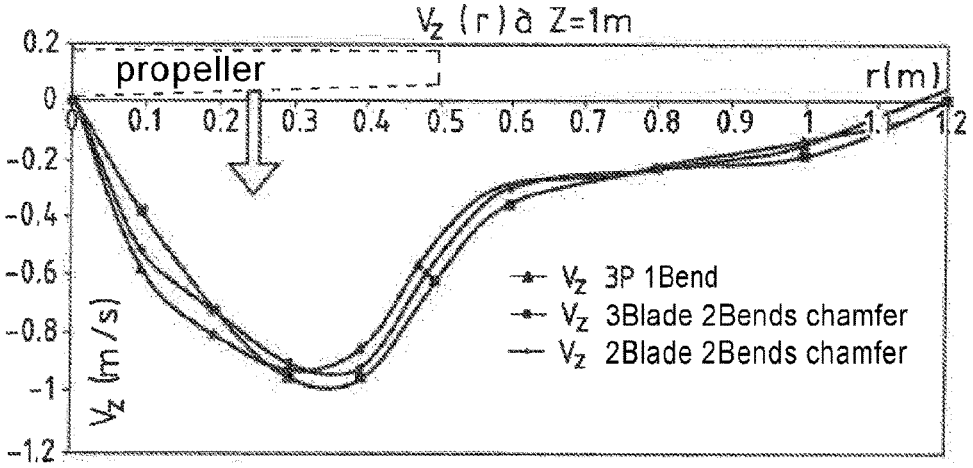
FIG. 13 is a graph illustrating the linear speeds at different points on the propellers.

FIG. 13 shows notably a profile of the range of speeds leaving the blade that is virtually identical for the three propellers proposed, by virtue of the surface area of the blade, of the bends and of the angles combined; a clearly identical axial profile is preserved.

The propeller is desired for its rather axial flow leaving the blade in order to be blown down to the bottom at the axis and to rise again at the wall so as to sweep any deposited particles from the bottom.

"Simple" propellers made up of blades that are inclined or formed with one bend do not make it possible to bring about a mostly axial flow on account of "radial and tangential leaks"; for the invention, a mostly axial flow is noted.

The manufacturing of the prior art propellers is complex.

In some cases, it requires a complex machine that can twist the blades for propellers having a diameter of 10 m, this being a single machine that is constantly in production.

Given their curvature, propellers of the saber type require a template for each diameter and shape, and hence a combination of more than one hundred templates.

It is relatively easy to manufacture the proposed propellers with the aid of a bending press; greater competitiveness of subcontractors is thus conceivable, i.e. a greater choice thereof.

The mechanical determination of a stirrer is dictated by its diameter and its speed of rotation for a given operation and consequently the power generated for the rotation of the member.

The saving in power for one and the same pumping flow, this being an essential calculation element for stirring to effect mixing, allows a saving in terms of the motor, the speed reducer transmitting the torque, in terms of the guiding system and in terms of the leaktightness, the shaft supporting the member and the thickness of the member. A saving of 20% in power between the proposed propeller and a marine propeller is noted, for example.

The economic saving that is brought about for the user from the point of view of investment is easily conceivable as the competitive advantage for the constructor.

The invention claimed is:

1. A stirring member (M), comprising:

a hub fastenable to a rotational shaft; and at least two blades attached to the hub, wherein each blade of the at least two blades has a leading edge facing fluid to be stirred and a trailing edge facing away from the leading edge, wherein each blade has an outer edge, with a distal end of the outer edge being remote from the hub and a proximal end that opposite to the distal end and nearest to the hub, wherein each blade is comprised of a bended flat sheet, the bended flat sheet of each blade having two longitudinal bends, a length of each of the longitudinal bends being greater than 60% of a maximum radius of the blade, wherein a radial axis of each blade is defined as through a center of rotation of the stirring member and perpendicular to the outer edge, an angle of incidence is defined as being an angle between the leading edge and the radial axis of the blade passing through the center of rotation and perpendicular to the outer edge, wherein the angle of incidence is positive, so that the distal end of the outer edge meets the fluid before the proximal end when the stirring member is in rotation, and wherein the angle of incidence is between 6° and 15°.

2. The stirring member (M) as claimed in claim 1, wherein the length of each bend is greater than 75% of the maximum radius of the blade.

3. The stirring member (M) as claimed in claim 2 wherein the two bends are parallel.

4. The stirring member (M) as claimed in claim 2, wherein at least one of the bends is perpendicular to the outer edge of the propeller.

5. The stirring member (M) as claimed in claim 1 wherein the two bends are parallel.

6. The stirring member (M) as claimed in claim 5, wherein at least one of the bends is perpendicular to the outer edge of the propeller.

7. The stirring member (M) as claimed in claim 1, wherein at least one of the bends is perpendicular to the outer edge of the propeller.

8. The stirring member (M) as claimed in claim 1, wherein the stirring member comprises only two blades.

9. The stirring member (M) as claimed in claim 1, wherein each blade has, on account of the presence of the two bends, a substantially U-shaped cross section in a plane parallel to an axis of rotation of the stirring member and parallel to the outer edge of the blade.

10. The stirring member (M) as claimed in claim 1, wherein each blade has, on account of the presence of the two bends, a substantially Z-shaped cross section in a plane parallel to an axis of rotation of the stirring member and parallel to the outer edge of the blade.

11. The stirring member (M) as claimed in claim 1, wherein, a section plane is defined as a plane transverse to a longitudinal direction of the blade, an intersection line is defined as an intersection between the section plane and a plane orthogonal to an axis of rotation of the stirring member, a departure angle is defined as an angle between the intersection line and a trailing edge face of the blade, and the departure angle is between 30° and 70°.

12. The stirring member (M) as claimed in claim 1, wherein, with a width of a distal end of the blade is denoted as "l" and a width at a base of the blade near an axis of rotation of the stirring member is denoted "L", $l > 0.5$ L.

13. The stirring member (M) as claimed in claim 1, wherein, for each blade, an angle of attack (a) between a face of the blade containing the leading edge and a central face of the blade is between 13 and 25°.

14. The stirring member (M) as claimed in claim 1, wherein, with a width of a distal end of the blade is denoted as "l" and a width at a base of the blade near an axis of rotation of the stirring member is denoted "L", $l > 0.75x$ L.

15. The stirring member (M) of claim 1, wherein a first bend (A) of the two longitudinal bends, being defined as a one of the two longitudinal bends which in rotation of the stirring member will meet the fluid first, is located along an axis passing through an axis of rotation of the stirring member.

16. The stirring member (M) of claim 1, wherein the distal end of the trailing edge is situated forward of the proximal end of said trailing edge and with respect to a direction of rotation of the stirring member, so that said distal end of the trailing edge meets the fluid before said proximal end of the trailing edge.

17. The stirring member (M) as claimed in claim 1, wherein, an angle of departure is defined between i) a face of the blade having the trailing edge, and ii) a plane orthogonal to the rotation axis, said departure angle being between 30° an 70°.

* * * * *